United States Patent [19]

Breski et al.

[11] 4,416,653

[45] Nov. 22, 1983

[54] APPARATUS FOR STACKING FAN-FOLDED PAPER

[75] Inventors: Thomas A. Breski, Binghamton, N.Y.; Robert A. Ryan, deceased, late of Endwell, N.Y., by The Bank of New York Inc., executor

[73] Assignee: International Business Machines Corporation, Armonk, N.Y.

[21] Appl. No.: 323,844

[22] Filed: Nov. 23, 1981

[51] Int. Cl.[3] ..... B65H 45/00

[52] U.S. Cl. ..... 493/412; 423/413

[58] Field of Search ..... 493/409–415, 493/430, 433; 226/118–119

[56] References Cited

U.S. PATENT DOCUMENTS 3,086,768 4/1963 Lach ..... 493/415

*Primary Examiner*—A. J. Heinz

*Attorney, Agent, or Firm*—John S. Gasper

[57] ABSTRACT

Apparatus for stacking a web of continuous prefolded paper forms includes a compacting mechanism having a plurality of elongate rigid compacting finger elements vertically suspended in pairs and freely pivotable from a horizontal rotating crankshaft located above and along one side of a paper stack. The finger elements which have a roughened active surface are vertically reciprocated by the crankshaft so that their active surface slidingly engages the topmost fold or edge of the stack during downward movement but disengages the stack during upward movement.

19 Claims, 8 Drawing Figures

88
91
92
90
89
87
93
85
82
81
82
86
84
83
83
94
62
52
59
84
59
53
63
51
50
60
60
54
70
54
55
55
56
56
57
57
70
65
33
31
64
66
20
29
30
35
19
27
27
22
28
28
23
27
25
27
34
39

37
32
40
38
36
41
42
43
44
45

APPARATUS FOR STACKING FAN-FOLDED PAPER

TECHNICAL FIELD

This invention relates to the stacking of fan-folded webs of paper or the like from a line printer or a similar device.

BACKGROUND OF THE INVENTION

A continuous web of business forms is usually fed from a printer mechanism for stacking. As the forms are deposited on a stack from the printer they tend not to refold as sharply and compactly as they were folded prior to processing. Various devices have been used to pack the forms down at the edges; such as rubber fingered belts, belt mounted plastic ribs and wheel mounted coiled or flat springs. The purpose of all these parking devices has been to intercept the folded edge of the form as it approaches the stack and to urge it downward onto the stack or pile thereby increasing the sharpness of the fold and the compactness of the stack. The prior devices are somewhat complicated, cumbersome to repair and are not easily adjustable for accommodating forms of different sizes.

BACKGROUND ART

U.S. Pat. No. 3,640,521 issued Feb. 8, 1972 to R. W. F. Hutley describes an apparatus for receiving a continuous web of prefolded forms from a high speed printer and a stacking device and then compacting them folded on a tray. Wheels having a plurality of flexible plastic rubber spokes or fingers radially projecting therefrom are fixed on a rotating shaft positioned above the top of the stack. The spokes are of such lengths as to beat down the forward fold of each top ply of the stack as it reforms. Depending rods limit the space into which the web is fed to fold the forms.

U.S. Pat. No. 3,460,825 issued Aug. 12, 1969 to F. C. Met et al. describes a stacker in which the outer edge of the refolding form is intercepted and retarded on its way to the pile to force the web to fold inwardly and to move downwardly along a guide before the outer edge is advanced.

U.S. Pat. No. 4,210,318 issued July 1, 1980 to H. R. VerMehren describes a fanfolding and stacking device which includes a pair of rotatable paddle wheels which fold a continuous web of business forms into a fanfolded stack but performs no compacting.

U.S. Pat. No. 4,095,779 issued June 20, 1978 to T. Imagi et al describes various prior art stacking devices using rotating belts, wheels and other devices for compacting folds of a continuous web in a stack.

SUMMARY OF THE INVENTION

It is the objective of this invention to provide a continuous web forms compactor which achieves the following:

1. Requires fewer and less complex parts than with belt or wheel patter mechanisms.
2. Allows adaptation to the varying conditions of forms and stack geometry.
3. Acts as guides for the formation of the stack and eliminates the need for fixed form guides under some conditions.
4. Avoids undue hindrance to the removal of forms from the stacker by an operator.

5. Avoids criticality in the adjustment of the position of the compactor mechanism.
6. Allows ready replacement of compactor elements.
7. Reduces the possibility of damage requiring replacement of compactor elements.

The above as well as other objects can be achieved in accordance with this invention by providing an apparatus for packing fanfolded paper in which the compacting elements comprise at least one pair of pendulum type fingers suspended from and freely pivotable on a cycling mechanism such as a crankshaft. The compacting fingers are carried by the crankshaft so that they are cycled out of phase with each other in a sort of walking motion into and out of engagement with the top edge of the top most fold on one or both sides of a fanfolded paper stack. The compacting fingers are suspended from pivot points on the crankshaft with the center of mass of the compacting fingers remaining below the pivot point. Being thus supported on the crankshaft, the pivots of the fingers are moved through a circular path which cyclically crosses over and down toward the edge of the paper stack. The stack crankshaft is located above and outside the edge of the stack; however, the crankshaft rotation causes the pivot point of the finger elements to pass over the edge of the paper stack. Because the fingers are freely pivoted and suspended downwardly, they readily accommodate variations in stack dimensions without adjustments in the location on the position of the operating mechanism. The stack can readily be removed since the fingers can be easily deflected due to their freely pivotable suspension. Fixed guides for the stack can be eliminated. Also the compacting fingers can have a snap-on construction which permits easy attachment and removal of the fingers from the crankshaft while at the same time maintaining a fixed pivot connection during operation.

DESCRIPTION OF THE PREFERRED EMBODIMENT

Figure 1:
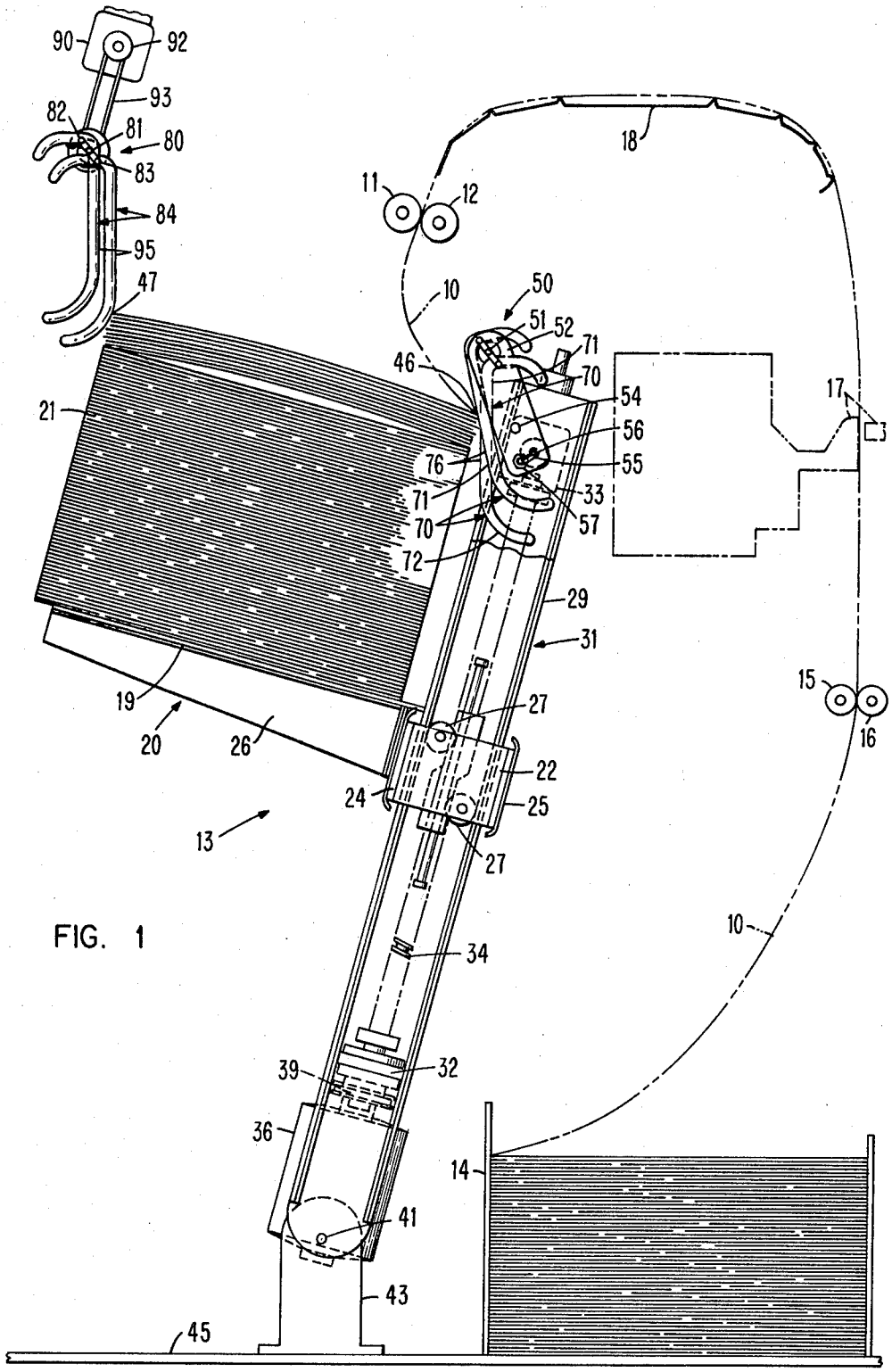
FIG. 1 is a perspective drawing of a stacking machine for stacking paper business forms utilizing the invention.

As seen in FIG. 1, a continuous web 10 consisting of business forms or the like is fed by drive rolls 11 and 12 located above a stack mechanism 13. Web 10 originated from a prefolded stack of business forms in a bin 14 to be fed through guide rolls 15 and 16 through a processing machine 17 such as a line printer and over a paper guide 18 in accordance with well known printer operation and paper feeding techniques. Details of the paper feeding mechanism such as tractors and other guide rolls have been eliminated for the sake of simplicity in illustrating the invention. As web 10 moves beyond paper guide 18, it is fed by stacker rolls 11 and 12 in a generally vertical direction until it reaches a shelf 19 of a stack platform 20 where it refolds along prefolded lines to form a paper stack 21. Shelf 19 is part of a movable stack platform 20 including side frame members 22 and 23 attached to front member 24 and rear member 25. A horizontal beam 26 attached to front member 24 provides support for shelf 19. Guide wheels 27 and 28 carried by platform frame members 22–25 allow stack platform 20 to travel along vertical guide rails 29 and 30 of the platform support frame 31 which includes cross pieces 32 and 33. An elevator mechanism for raising and lowering stack platform 20 includes worm gear 34 journaled to cross pieces 32 and 33 and traveling nut 35 journaled to frame member 25 of platform 20. A reversible electric motor 36 attached to cross piece 32 by bracket 37 provides bidirectional motive power to worm gear 34 via drive belt 38 wrapped around motor pulley 39 and worm pulley 40. Pivot pins 41 and 42 secure the bottom ends of guide rails 29 and 30 to fixed standards 43 and 44 supported by horizontal base 45 which may be part of the machine frame for printer mechanism 17 and paper guide 18. In this manner, the entire stack mechanism 13 is made angularly adjustable to accommodate various operating parameters associated with stacking web 10 on shelf 19.

Figure 2:
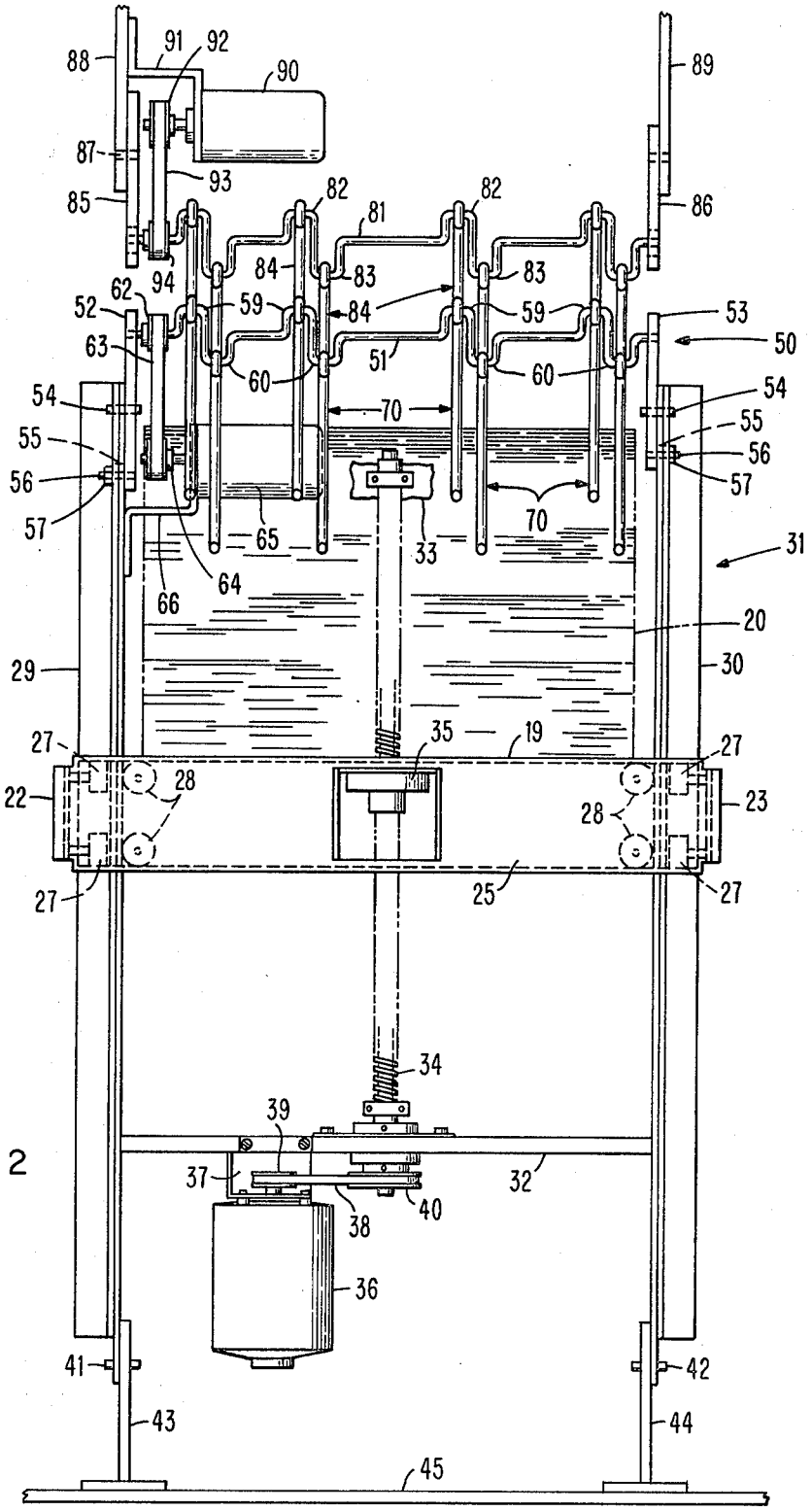
FIG. 2 is a front elevation of the machine of FIG. 1.

As shown in FIGS. 1 and 2, paper stack 20 is compacted at both inner edge 46 and outer edge 47 by separate compacting mechanisms 50 and 80. The inner compacting mechanism 50 comprises a horizontal crankshaft 51 rotatably carried by spaced brackets 52 and 53 which are pivotally attached by pins 54 at the upper end to guide rails 29 and 30. Brackets 52 and 53 are provided with curved slots 55 which coact with threaded studs 56 fixed on guide rails 29 and 30 and lock nuts 57 so that brackets 52 and 53 may be angularly adjusted and set in order that crankshaft 51 can be adjustably located relative to the top of paper stack 20 and inner edge 46.

Figure 7:
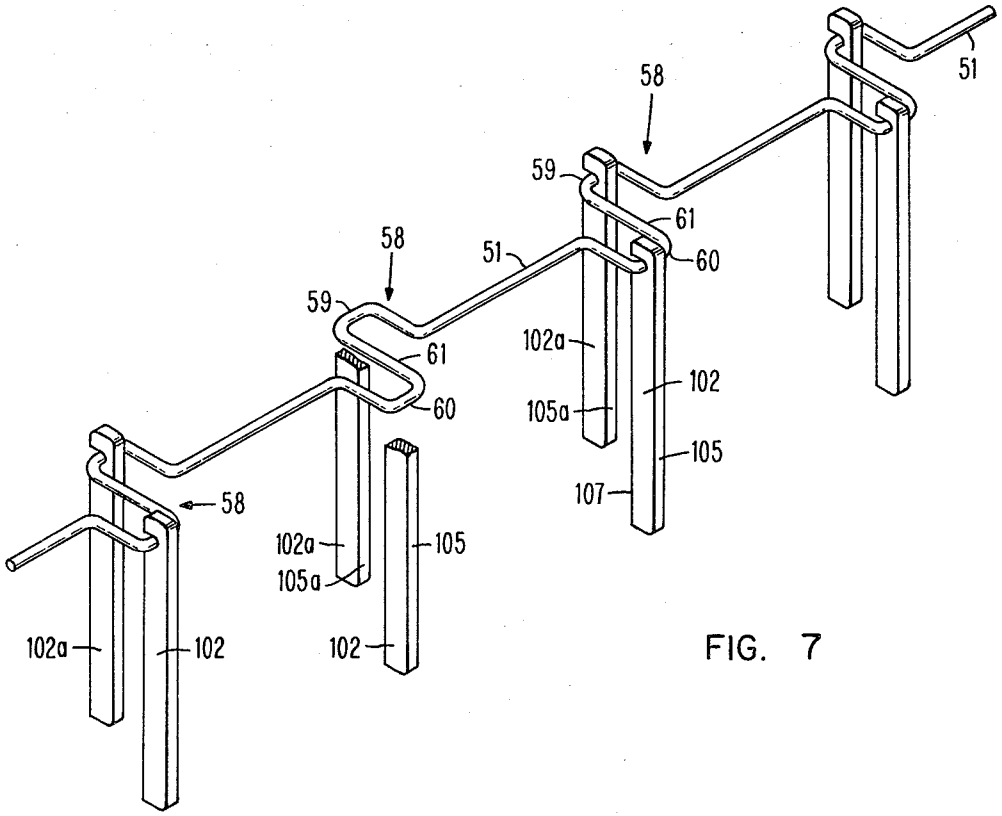
FIG. 7 is a three dimensional view of a portion of the compactor mechanism useful in the mechanism shown in FIGS. 1 and 2.

As best seen in FIGS. 2 and 7, crankshaft 51 can be a single circular rod with a plurality of double bends 58 which form a plurality of double cranks having parallel crank pins 59 and 60 at several spaced locations along crankshaft 51. Preferably crank pins 59 and 60 have the same radius relative to the center of rotation of crankshaft 51 are are separated by 180 degrees of circular arc during rotation. Also crank pins 59 an 60 are grouped in pairs along crankshaft 51 by connection to a common crank web or arm 61. Thus as crankshaft 51 is rotated on brackets 52 and 53, crank pins 59 and 60 rotate in a closed circular path 180 degrees out of phase with each other. Thus during rotation crank pin 59 is moving downward while crank pin 60 would be moving upward ralative to the inner edge 46 of paper stack 20 and vice versa. Crank pulley 62 on the left end (FIG. 2) of crankshaft 51 provides the drive connection via drive belt 63 and motor pulley 64 to a unidirectional motor 65 secured by bracket 66 to guide rail 29. Electric motor 65 is always operated to rotate crankshaft 51 in the counterclockwise direction.

Inner compacting mechanism 50 further comprises a plurality of compacting elements or fingers 70 pivotally suspended from crankpins 59 and 60. When thus assembled onto crank pins 59 and 60, fingers 70 are arranged essentially in pairs at a plurality of locations along the length of crankshaft 51. Fingers 70 are free and unrestricted to pivot on crank pins 59 and 60 and therefore their angular positions are determined by the location of their centers of gravity and external forces exerted on them which produce angular deflection.

Figure 3:
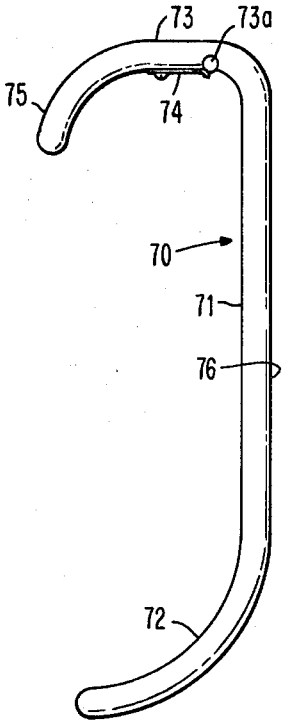
FIG. 3 is a detailed drawing showing one of the compactor elements used in the machines of FIGS. 1 and 2.

Fingers 70 in the embodiment shown in FIGS. 1, 2 and best seen in FIG. 3 are essentially slender rods having a straight stem 71 with a curved tail section 72 at the lower end. At the upper end of stem 71, fingers 70 are constructed with a horizontal handle 73 having a circular groove 73*a* enclosed in part with a resilient 74 which is manually deflectable to allow crank pins 59 and 60 to be received into groove 73*a*. Handle 73, which can also have a curved end 75, should be large enough for manual grasping to permit assembly and removal of fingers 70 from crank pins 59 and 60; however, the size and shape of handle 73 must take into account its movement arm relative to stem 71 and tail 72 so that proper deflection and compaction forces are always applied to the folds and edges of web 10 on stack 20. Handle 73 is preferably designed to maintain stem 71 essentially vertical when suspended from crank pins 59 and 60 thereby counterbalancing tail 72. Other structures which provide free pivoting and which permit fingers 70 to be attached to crank pins 59 and 60 with or without snap action can be provided. In any event, the attachment structure must be such as to provide for free pivotal and unrestrained rotation of the fingers solely as a result of the location of their centers of gravity and external deflection forces which are applied along the active surface 76 which is adjacent the inner edge 46 of paper stack 20.

Active surfaces 76 on fingers 70 is preferably rough, e.g. with small projections, for obtaining optimum deflection and compression to produce the optimum compaction forces during deflection and downward travel of fingers 70 as they are moved by circular travel of crank pins 59 and 60 resulting from the rotation of crankshaft 51. The active surface 76 of the crank pins may extend the entire length of stem 71 and tail 72 or so much of the length thereof to assure that the most effective contact is made with inner edge 46 throughout all or the major portion of the downward motion of fingers 70. The degree of roughness or the size of the projections from active surface 76 can vary depending on several conditions including desired compaction force, web strength, and quality or other properties of web 10. So far as wear or damage to printed matter or the web is concerned, the degree of roughness could be minimal consistent with the desired deflection and compaction forces consistent with good compaction of stack 20. Also a rate of tapping provided from fingers 70 due to the speed of rotation of crankshaft 51 can also be varied.

As seen in FIGS. 1 and 2 an outer edge compacting mechanism 80 comprises crankshaft 81 with crank pins 82 and 83 from which compacting fingers 84 are pivotally suspended. Crankshaft 81 is supported in a horizontal manner above outer edge 47 of paper stack 20 by brackets 85 and 86 (see FIG. 2) pivotally secured by pins 87 to stationery frame members 88 and 89. Brackets 85 and 86 are angularly adjustable on frame members 88 and 89 in the same manner as brackets 52 and 53 can be angularly adjusted on guide rails 29 and 30. This angular adjustment of brackets 85 and 86 permits proper location and fixing of the center of rotation of crankshaft 81 relative to the outer edge 47 of paper stack 20 to accommodate various form sizes and folds of web 10. Electric motor 90 is attached by bracket 91 to side frame 88 and is drive connected to crankshaft 81 by motor pulley 92, belt 93 and crankshaft pulley 94. Motor 90, when operated, always rotates crankshaft 81 in the clockwise direction as shown in FIG. 1. When operated in this direction, the roughened active surface 95 on compacting fingers 84 always engages outer edge 47 of paper stack 20 during the downward portion of their movement by rotation of shaft 81.

Figure 8:
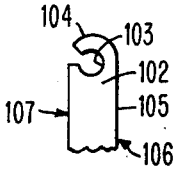
FIG. 8 is a side view showing a fragment of the compactor elements of FIGS. 4–7.

In other embodiments, compacting fingers can take other forms. In FIGS. 4–7 and 8 compacting fingers 102 and 102*a* are straight, slender, rectangular bars. As best seen in FIG. 8, the upper end of fingers 102 has a circular bearing 103 with a flexible sector 104 for snap connection onto crank pins 82 and 83 of crankshaft 81 or crank pins 59 and 60 of crankshaft 51. The active surface 105 is also preferably along the entire length of vertical edge 106 of bar 102. Alternatively, vertical edge 107 can also have a rough surface which allows the rectangular bars 102 and 102*a* to be mounted in either way to the crank pins. Similarly, finger 102*a* has active surface 105*a* on vertical edge 106*a*.

The various embodiments of compacting fingers shown can be constructed from various materials. For example, they may be made of metal, plastic or synthetic rubber. The selection of materials could be made dependent on various factors such as weight, wearability, desired to create roughness relative to the compaction forces and deflection that is desired dependent on the qualities of the web and the speed of stacking. This configuration of the compacting mechanisms 50 and 80 permits wide variety of choices providing versatility not previously achievable in paper compacting mechanisms.

Figure 4:
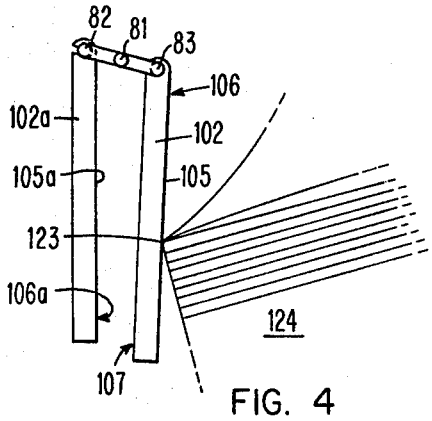
FIGS. 4, 5 and 6 are schematic representations showing the sequence of operation of the compactor mechanism of FIG. 1. In these figures a second embodiment of a compactor element is also shown.
Figure 5:
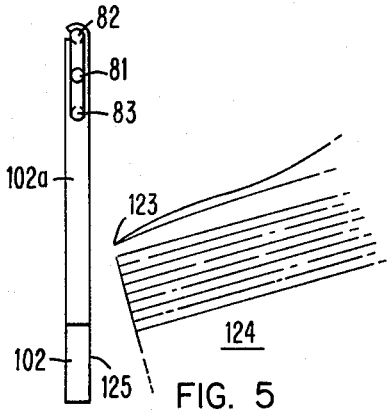
Figure 6:
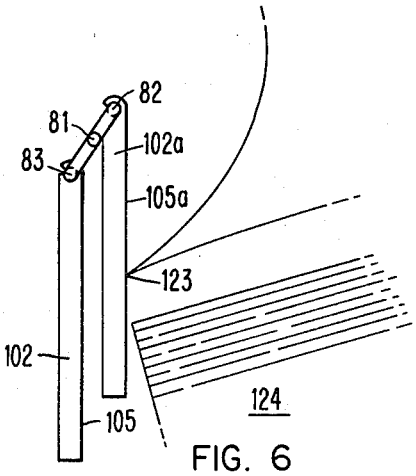

The operation of the compacting mechanism shown in the schematics of FIGS. 4–6 is as follows. Crankshaft 81 is rotated in a clockwise direction. In FIG. 4 crank pin 83 has moved compacting finger 102 in a downward direction causing it to be deflected clockwise by engagement with edge 123 of paper stack 124. Due to the action of active surface 105, finger 102 will have been deflected a maximum amount sliding along edge 123 and applying a downward force to edge 123 and stack 124. Finger 102*a* pivoting freely on crank pin 82 hangs suspended out of engagement with stack 124. FIG. 5 shows both compacting fingers 102 and 102*a* disengaged from stack 124 and in perfect vertical alignment as crank pins 82 and 83 are vertically aligned with the center axis of crankshaft 81. With this condition of the compacting mechanism, web 10 forms a loose fold at the upper edge 123. FIG. 6 shows the compacting finger 102*a* at the beginning of its downward motion and deflection clockwise around crank pin 81. Due to the roughness of active surface 105*a*, compacting finger 102*a* will be further deflected as crank pin 82 continues moving clockwise. Compacting finger 102 is suspended from crank pin 83 and assumes a vertical position out of engagement with stack 124. The process is repeated cyclically any number of times and at any rate desired.

As seen from the previous description, a compacting mechanism has been provided which is simple to construct, operates effectively and can be widely varied to suit a large variety of operating parameters. In addition, a compacting mechanism is provided in which the compacting elements can easily be replaced when wearing becomes excessive or breakage occurs. Also, the compacting elements can be easily interchanged for various operating parameters. In addition, a further advantage is readily apparent when it is the desire to remove the paper stack 21 from the stack mechanism 13. As readily seen in FIG. 1, paper stack 21 can be readily removed from shelf 19 without disturbing either the stacking mechanism 13 or the compacting mechanisms 50 or 80. Removal of stack 21 is easily achieved and causes no disturbance to compacting mechanism 80 except to deflect fingers 84. No special harm can take place resulting from such deflection and without stack 21 present, fingers 84 readily swing back into position for further compaction as stack 21 rebuilds on shelf 19 to the level desired by lifting platform structure 20 to the desired level along guide rails 29 and 30.

While the present invention has been described in the context of preferred embodiments thereof, it will be readily apparent to those skilled in the art, that modifications and variations can be made therein without departing from the spirit and scope of the present invention. Accordingly, it is not intended that the present invention be necessarily limited to the specifics of the foregoing description of the preferred embodiment, but rather as being limited only by the scope of the invention as defined by the claims appended hereto.

What is claimed is:

1. An apparatus for stacking a web of continous prefolded paper forms comprising means for advancing said web in elongated form for refolding into a fan-folded stack, stack support means for receiving said web from said advancing means and supporting said stack, said stack support means being movable for adjusting the position of the uppermost edge formed by the uppermost layer of said stack relative to said means for advancing said web, and a compacting mechanism for compressing said stack on said stack support means during folding of said web onto said stack including a plurality of elongate rigid compacting elements vertically suspended along and to one side of said stack, said compacting elements having a pivot connection above and a free end terminating below said uppermost layer of said stack, said compacting elements having an active surface between said pivot connection and said free end facing said one side of said stack, and means for imparting a downward stroke to said vertically suspended compacting elements whereby said active surface of said compacting elements is brought into sliding engagement with said uppermost edge of said stack then an upward stroke when said vertically suspended compacting elements are disengaged from said stack, said compacting elements being freely pivotable at said pivot connection during said downward and upward strokes.

2. An apparatus for stacking a web in accordance with claim 1 in which said means for imparting said downward and upward strokes to said compacting elements comprises means for continuously revolving said pivot connection of said compacting elements in a continuous path of revolution above said stack, said path of revolution including a portion traveled by said pivot connection which crosses over said upper edge of said stack during said downward stroke whereby said active surface of said compacting elements slidingly engages said edge of said stack during said downward stroke, said compacting elements being freely deflectable relative to said pivot connection during said sliding engagement in the course of said downward stroke.

3. An apparatus for stacking a web in accordance with claim 2 in which said plurality of compacting elements have said pivoted connection angularly spaced for phased downward and upward strokes of said compacting elements whereby some of said compacting elements are slidingly engaged during said downward stroke while others of said compacting elements are disengaged from said stack during said upward stroke.

4. An apparatus for stacking a web in accordance with claim 3 in which said plurality of compacting elements are arranged in at least one compacting element pair, and said pivoted connections for said pair are angularly spaced 180 degrees.

5. An apparatus for stacking a web in accordance with claim 4 in which said means for imparting said phased downward and upward strokes to said compacting elements is a crank mechanism.

6. An apparatus for stacking a web in accordance with claim 5 in which said crank mechanism includes a rotating crankshaft, said crankshaft having multiple crank pins at spaced locations extending along said crankshaft, said compacting elements being freely pivotable from said multiple crank pins at said pivot connection of said compacting elements.

7. An apparatus for stacking a web in accordance with claim 6 in which said crank pins of said crankshaft are formed in crank-pin pairs spaced along the length of said crankshaft for pivotally carrying said compacting elements in compacting element pair vertically suspended in parallel rows along said one side of said stack.

8. An apparatus for stacking a web in accordance with claim 7 in which said crankshaft is a cylindrical rod, and said plurality of crank pin pairs are formed by a plurality of double bends in said rod forming said crank pin pairs.

9. An apparatus for stacking a web in accordance with claim 8 in which said double bends in said cylindrical rod forming said crank pin pairs includes parallel crank pins having one end connected by a common crank web.

10. An apparatus for stacking a web in accordance with claim 6 in which said means for advancing said web comprises feed rolls having a fixed position relative to said stack support means, said stack support means includes vertical support means and a horizontal shelf vertically movable along said vertical support means below said feed rolls for supporting said stack, said vertical support means being laterally movable for adjusting the position of said horizontal shelf relative to said fixed position of said feed rolls, and said rotating crankshaft is a horizontal crankshaft carried by crankshaft support means attached to said vertical support means, said crankshaft being movable with said vertical support means and said horizontal shelf relative to said feed rolls for accommodating different sizes of said prefolded paper forms.

11. An apparatus for stacking a web in accordance with claim 10 which further comprises a horizontal base plate below said feed rolls, and said vertical support means is pivotally connected to said base plate at one end, said crankshaft support means being attached to said vertical support means at the other end of said vertical support means above said shelf, said vertical support means being angularly movable for adjusting said crankshaft and said horizontal shelf relative to said feed rolls for accommodating different sizes of said prefolded paper forms.

12. An apparatus for stacking a web in accordance with claim 11 in which said crankshaft support means comprises bracket means pivotally attached to said vertical support means for angularly adjusting said crankshaft and said compacting elements vertically suspended therefrom relative to said uppermost edge of said stack.

13. An apparatus in accordance with claim 6 in which said compacting elements are cylindrical rods having said active surface on the periphery thereof.

14. An apparatus in accordance with claim 13 in which said cylindrical rods forming said compacting elements comprise a vertical stem and a curved tail section at one end, said tail section terminating below said uppermost layer of said stack, and said active surface extends along the periphery of said stem and said tail section so as to face said one side of said stack.

15. An apparatus in accordance with claim 14 in which said cylindrical rods forming said compacting elements further comprise a handle section extending from the upper end of said vertical stem, and said handle has means forming said pivot connection, said handle forming a counter balance relative to said pivot connection and said stem and tail section.

16. An apparatus in accordance with claim 15 in which said counterbalance formed by said handle returns and maintains said stem in vertical position when disengaged from said stack.

17. An apparatus in accordance with claim 15 in which said means forming said pivot connection comprises a leaf spring or the like forming a snap connection for said compacting elements.

18. An apparatus in accordance with claim 1 in which said compacting elements are straight rectangular rods having said active surface on one edge of said rods facing said stack.

19. An apparatus for stacking a web of continuous prefolded paper forms comprising means for advancing said web in elongated form for refolding into a fan-folded stack, stack support means for receiving said web from said advancing means and supporting said stack, said stack support means being movable for adjusting the position of the uppermost edge formed by the uppermost layer of said stack relative to said means for advancing said web, and a compacting mechanism for compressing said stack on said stack support means during folding of said web onto said stack including at least one elongate rigid compacting element vertically suspended along and to one side of said stack, said compacting element having a pivot connection above and a free end terminating below said uppermost layer of said stack, said compacting element having an active surface between said pivot connection and said free end facing said one side of said stack, and means for imparting a downward and upward stroke to said compacting element whereby said active surface of said compacting element is in sliding engagement with said uppermost edge of said stack during the downward stroke and is disengaged from said stack during the upward stroke, said compacting element being freely pivotable at said pivot connection during said downward and upward stroke.

* * * * *